US006018960A

United States Patent [19]

Parienti

[11] Patent Number: 6,018,960

[45] Date of Patent: Feb. 1, 2000

[54] AUTOMATICALLY INFLATABLE, DEFLATABLE AND FOLDABLE SOLAR-POWERED COOLER MATTRESS WITH A SUNSHADE

[76] Inventor: Raoul Parienti, 5 Rue de Belgique - 06000, Nice, France

[21] Appl. No.: 09/043,468

[22] PCT Filed: Jul. 22, 1996

[86] PCT No.: PCT/FR96/01147

§ 371 Date: Mar. 20, 1998

§ 102(e) Date: Mar. 20, 1998

[87] PCT Pub. No.: WO97/04690

PCT Pub. Date: Feb. 13, 1997

[30] Foreign Application Priority Data

Jul. 26, 1995 [FR] France ..... 95 09351

[51] Int. Cl.[7] ..... F28D 5/00

[52] U.S. Cl. ..... 62/314; 62/315; 62/304; 62/331; 62/35.1

[58] Field of Search ..... 62/315, 304, 314, 62/331, 35.1

[56] References Cited

U.S. PATENT DOCUMENTS

| | | | |
|---|---|---|---|
| 4,141,585 | 2/1979 | Blackman | 297/180 |
| 4,248,255 | 2/1981 | Arrowsmith | 135/5 |
| 4,823,415 | 4/1989 | Lampard | 5/93 |
| 4,865,381 | 9/1989 | Van Rogue | 297/184 |
| 4,969,684 | 11/1990 | Zarotti | 297/180 |
| 4,977,633 | 12/1990 | Chaffee | 5/453 |
| 5,022,107 | 6/1991 | Knotts | 5/419 |
| 5,715,695 | 2/1998 | Lord | 62/259.3 |
| 5,802,865 | 9/1998 | Strauss | 62/259.3 |

FOREIGN PATENT DOCUMENTS 0 141 220 A1 5/1985 European Pat. Off. .

*Primary Examiner*—Henry Bennett
*Assistant Examiner*—Mark Shulman
*Attorney, Agent, or Firm*—Lydon & Brown, LLP

[57] ABSTRACT

An automatically inflatable, deflatable and foldable solar-powered cooler mattress with a sunshade, including an auxiliary device for automatically inflating and deflating the mattress, which device includes an array of photovoltaic cells (1) for supplying the power needed to operate a motor (2) driving a turbine (4) which rotates to draw air in through a channel (9) in the mattress (5), said motor (2) also being operable to deflate the mattress (5) when the polarity of the motor power supply is reversed; a beverage cooler device comprising a water-soaked foam cylinder (17) so that when the turbine (4) is driven by the motor (2) to generate an air flow, said air flow causes evaporation of the water, thereby cooling the cylinder and an ultra-lightweight adjustable sunshade (10), one edge of the mattress being provided with a guide rail and a clamping system enabling the sunshade to be used in a variety of positions.

21 Claims, 3 Drawing Sheets

AUTOMATICALLY INFLATABLE, DEFLATABLE AND FOLDABLE SOLAR-POWERED COOLER MATTRESS WITH A SUNSHADE

BACKGROUND OF THE INVENTION

If the world of leisure and holidays seems to expand widely—to convince oneself, all is needed is considering the stream of holidaymakers who go to the seaside or to the mountain each year—it is nonetheless true that said holidaymakers pay more and more attention to their unnecessary expenses. For example, renting one or more beach mattress may account for an important part of the family's budget.

Of course, an inflatable mattress can be bought, but its implementation requires a true physical exercise, both for inflating-deflating and for carrying and storing it.

The invention set forth in this document is intended to overcome all these drawbacks.

SUMMARY OF THE INVENTION

Said invention is made up of an inflatable mattress and an associated device for automatic inflating and deflating of the mattress. This device is made interdependent with the mattress by means of gluing or any other means. No more need to get an air pump or being exhausted due to manual inflation: a photovoltaic cell array (1) supplies the power needed to operate a motor (2) driving a turbine (4) that enables the inflating of the mattress (5).

Conversely, the same motor is used to deflate said mattress when its power supply polarity is reversed by means of a three-position switch (3).

DETAILED DESCRIPTION OF THE PREFERRED EMBODIMENTS

Furthermore, the mattress is made up of foldable panels enabling for example, from an effective size of 180 centimetres by 50 centimetres to get after folding an object whose size is only 50 centimetres by 47 centimetres, thus making its carrying easy, thanks to handles.

According to a more sophisticated embodiment of the invention, the part intended to be at the contact of the ground is made up of semi-rigid panels (27), coated with plastic or other, what will provide:

better insulation of the user against a pebbly ground, easier folding and carrying, functional decoration and/or advertising support.

Figure 1:
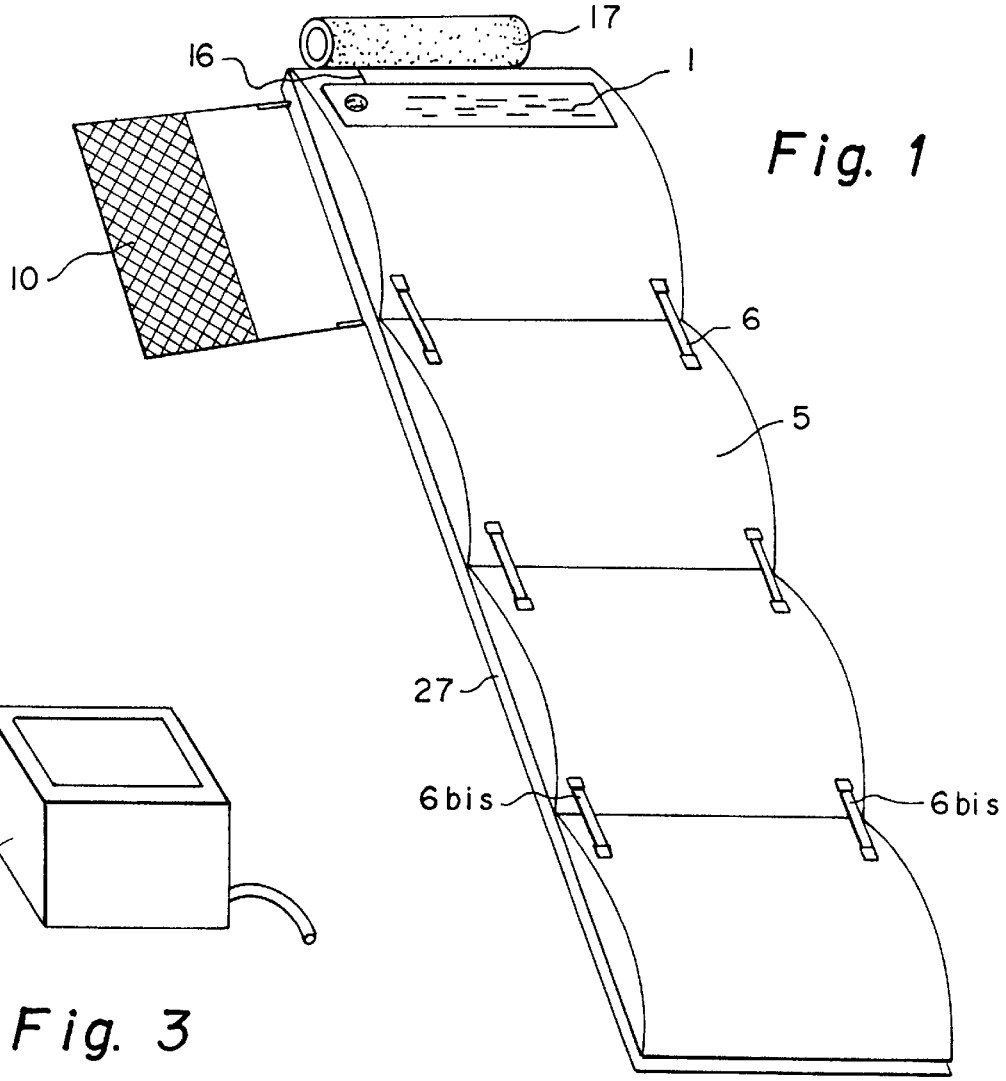
FIG. 1 is a plan view of the solar powered mattress of the present invention.

Referring to FIG. 1, the various panels that make up the mattress can be linked together by means of elastic straps (6) having differentiated restoring forces enabling automatic folding of panels according to a planned order.

For example, the elastic straps (6 bis) that link the lower panel with the intermediary lower panel will be designed so that they have the greatest force, thus enabling the folding of the lower panel against the intermediary lower panel first when inflating, and last when deflating, and so on.

Furthermore, the mattress can be provided with pockets meant for receiving a beach towel or various small objects.

Figure 11:
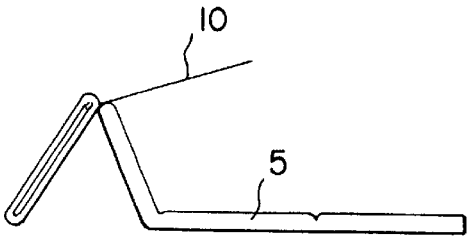
FIG. 11 is a cross-section of the solar powered mattress in an intermediary position.

As shown in FIG. 11, the mattress object of the present invention has fastening items enabling to use it while in lying, sitting or intermediary position.

Figure 8:
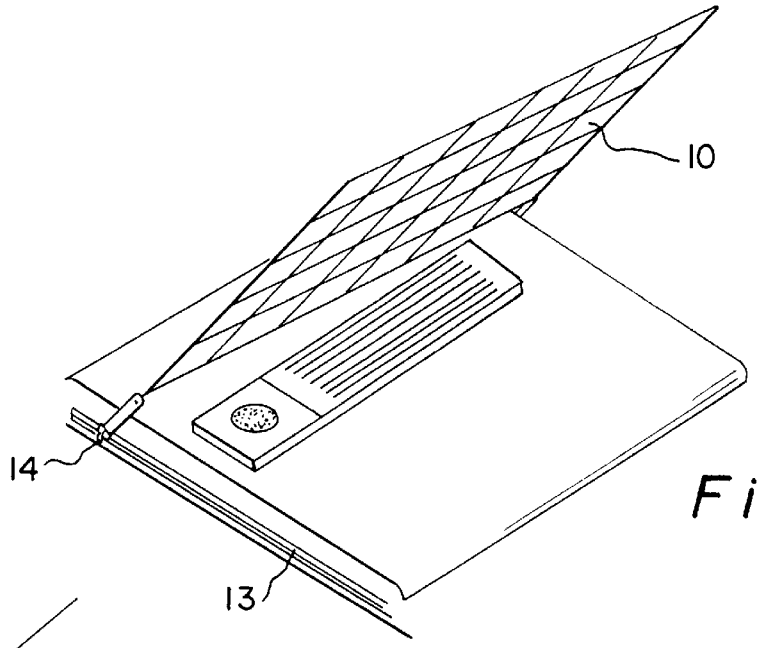
FIG. 8 is a plan view of the adjustable sunshade system of the present invention.
Figure 9:
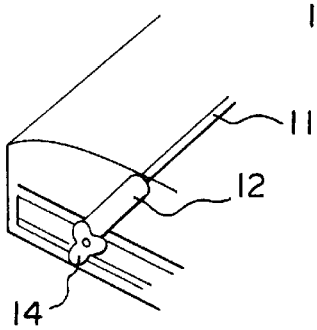
FIG. 9 is a detailed view of a clamping device adapted to secure the adjustable sunshade system to the solar powered mattress of the present invention.

Moreover, the invention comprises an ultra-lightweight adjustable sunshade system (10). Referring to FIGS. 8 and 11, the upper edge of the mattress is provided with a guiding rail (13) together with a clamping device (14) for using said sunshade while in lying, sitting or intermediary position. The sunshade is secured by means of two rigid rods (11), meant for being fitted into a support sleeve (12) fixed to the fastening device (14), as shown in FIG. 9.

Figure 10:
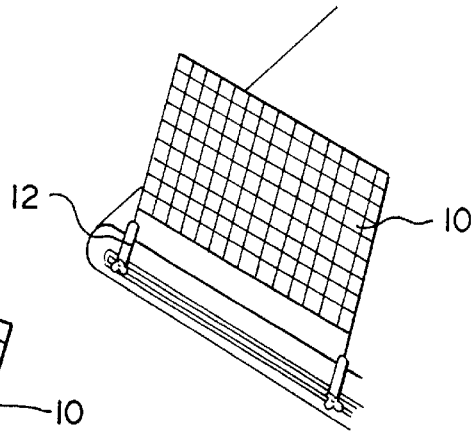
FIG. 10 is a plan view showing the adjustable sunshade system attached to the side of solar powered mattress at two points.
Figure 13:
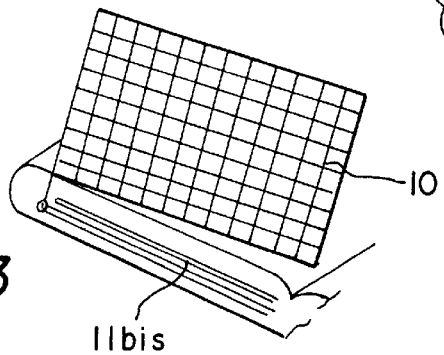
FIG. 13 is a plan view of the adjustable sunshade system attached to the solar powered mattress at a single point.

The sunshade rods (11) are connected to or removed from the sleeve (12) according to any prior art device. The fastening device can be located by the side (FIG. 10), even by means of a single rod (11), the useless rod (11 bis) having the capability of being folded onto the rail (13) (FIG. 13).

The rail (13) is fixed preferably on the upper part of the mattress.

Furthermore, the mattress (5) can be adapted to the mountain world and comprise, for example, a bedding device made preferably of new, light and insulating materials. Said bedding device can be made interdependent with the mattress through any of prior art processes, zipper or others.

Figure 12:
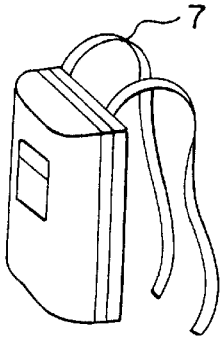
FIG. 12 is a plan view showing an embodiment of the solar powered mattress as a rucksack.

As shown in FIG. 12, the invention can also be provided with straps (7) meant for carrying it in the manner of a rucksack and comprise storage pockets like a typical rucksack.

Figure 5:
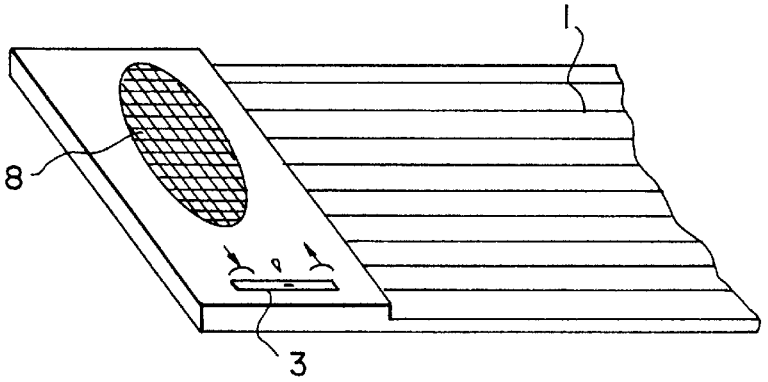
FIG. 5 is a plan view of a device for inflation/deflation of the solar powered mattress of the present invention.

According to an embodiment of the invention, the latter comprises a photovoltaic cell array (1), a motor (2) powered by said cell array, a thier position switch (3) (FIG. 5), each position being associated with a pictogram depicting the following functions:

inflating, deflating, stop.

Figure 4:
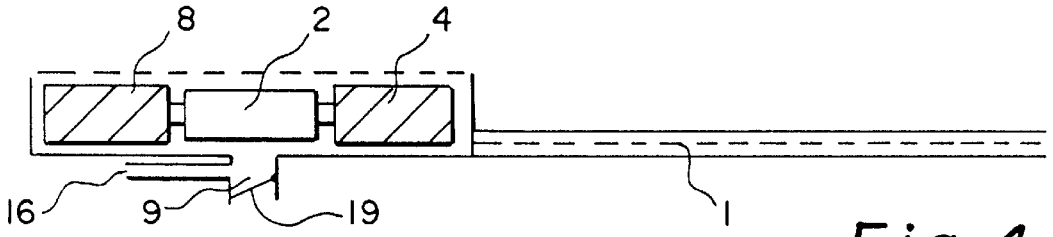
FIG. 4 is a cross-section of the device shown in FIG. 5.

Switching from inflating to deflating function is performed by reversing the polarity of the motor (2) that drives the turbine (4). Inflating is performed through the rotation of the turbine in one direction, what causes the suction of ambient air through the protective grid (8) and the introduction of the air into the mattress through the pipe (9). Likewise, deflating is performed through the rotation of the turbine in the reverse direction, what causes the suction of the air from the mattress and its exhausting to the exterior (FIG. 4).

Figure 6:
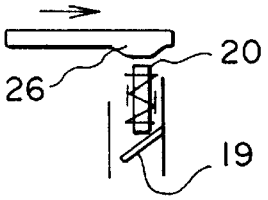
FIG. 6 is a cross-section view showing an air valve feature of the solar powered mattress of the present invention.

As shown in FIG. 6, the pipe (9) is provided with a valve (19) that prevents the air from getting out, once the mattress is inflated as a result of the action of the turbine. This valve (19) is open through the action of a rod (20) when the switch (3) is on the inflating position, what causes air exhausting. This rod (20) can, for example, be operated by the translation of the switch which, in the deflating position, moves horizontally a boss (26), thus causing the vertical translation of the rod.

The invention being mainly used in a sunny and hot weather, and most often on a beach, it will be further equipped with an ancillary cooler device capable of cooling a beverage for example.

Figure 7:
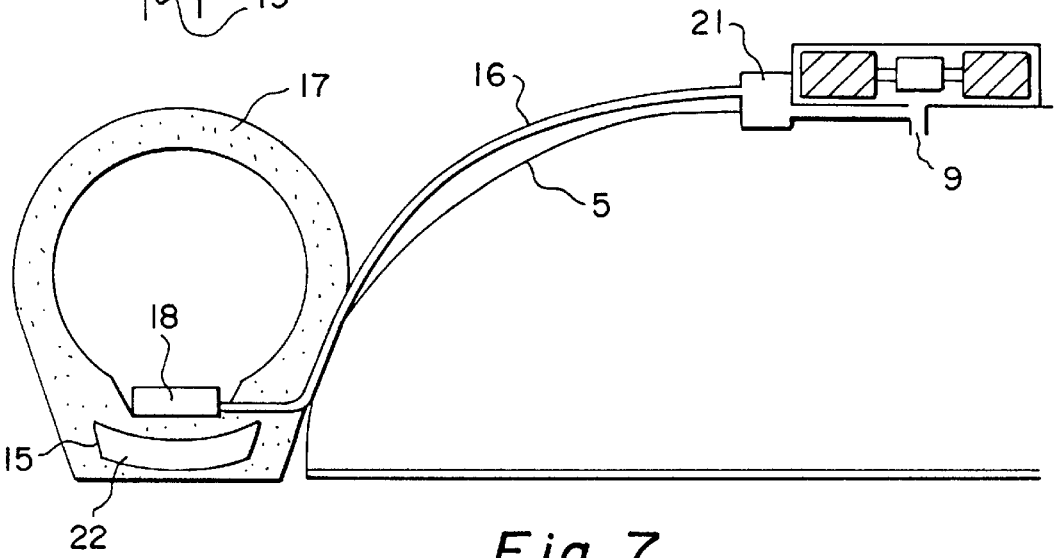
FIG. 7 is a cross-section view of one end of the solar powered mattress of the present invention, showing an air powered cooling feature of the invention.

To that end, as the above-mentioned device used for inflating and deflating the mattress (5) is provided with photovoltaic cells (1), a motor (2), and a turbine (4), it will be capable of producing an air flow. In order to perform a cooler function, said air will not be blown into the mattress but diverted to a pipe (16) that bypasses the pipe (9) and directed to a porous cylinder (17) made of foam or any suitable material by means of a diffuser pipe (18) provided with many holes that enable a homogeneous diffusion of the air (FIG. 7).

When inflating, the pipe (16) can be closed by the user, thanks to a pinching system (21) or any other prior art device, so that the whole air pumped out by the turbine (4) be blown into the mattress.

The foam cylinder (17) is designed to receive an object, a beverage or other foodstuff to be cooled. Said cylinder (17) will have to be soaked with water so that the evaporation of the latter, under the effect of the air flow produced by the turbine, produce a well known cooling effect (heat absorption as a result of evaporation).

The base of the cylinder (17) can usefully be provided with a water container (22) having a waterproof wall (15), designed so that said water can rise by capillarity into the cylinder (17).

Figure 3:
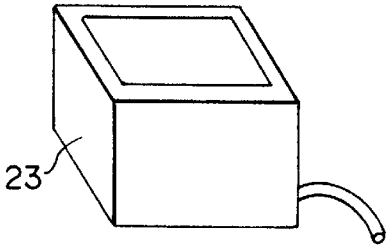
FIG. 3 is a plan view of a cooler box which may be operatively attached to the solar powered mattress of the present invention.
Figure 2:
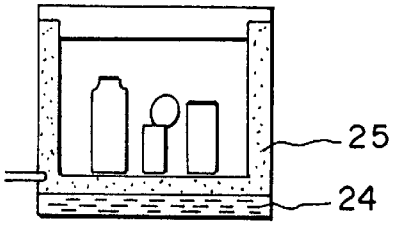
FIG. 2 is a cross-section view of a cooler box which may be operatively attached to the solar powered mattress of the present invention.

According to another embodiment, this cooler principle can be applied to a box (23) separated from the mattress (FIG. 3). Said box will have a water stock (24) and a porous body (25) wherein water will go up by capillarity. This water is meant for being evaporated due to the effect of the air flow produced by the turbine (4), thus causing a cooling effect inside the box (FIG. 2).

Said cooling box (23) can also be used as an air cooler in a small enclosed place such as a tent, a caravan, a car or other.

For such a use, the powering device comprising the photovoltaic cell system, the motor and the turbine can as well be detached from the mattress, a pipe linking said device either to the mattress, or to the cooling box (23). That way, the dissociated system can also be used to other ends, such as inflating of deflating air mattresses.

The shapes, dimensions, and arrangements of the various components might vary within the limits of equivalent items, without changing the general design of the above-mentioned invention.

I claim:

1. An inflatable, deflatable and foldable solar-powered mattress, comprising:

(i) an inflatable air mattress having at least one air inlet;

(ii) a device for inflating and deflating the mattress, said device comprising (a) an electric motor;

(b) an array of photovoltaic cells for supplying electric power to operate said motor;

(c) a turbine operatively attached to said motor, said turbine adapted to alternatively force air into and out of said air mattress through said air inlet, thereby inflating and deflating said mattress, respectively, when a polarity of the power supply of said motor is reversed by operating a switch;

(iii) a device adapted to cool a beverage or other foodstuff contained therein, said device comprising (a) a foam cylinder having a base, said cylinder having walls which may be saturated with water;

(b) a diffuser air pipe having many holes and located in said base, (c) an air pipe having one end connected to said porous pipe and whose other end is operatively connected to an air flow produced by said turbine, such that air can be forced through the holes of said porous pipe and cause evaporation of water contained within said cylinder walls, thereby reducing a temperature of said cylinder to produce a cooling effect; and (iv) a sunshade operatively attached to said air mattress.

2. The solar-powered mattress of claim 1, wherein said sunshade may be adjusted from one position to another.

3. The solar-powered mattress of claim 1, wherein the edge of said air mattress is provided with a guiding rail and a clamping system to enable adjustment of the sunshade.

4. The solar-powered mattress of claim 1, wherein said turbine is operatively connected to ambient air by a protective grid, and wherein said turbine blows air into the mattress air inlet via a pipe.

5. The solar-powered mattress of claim 1, wherein said switch comprises a three-position switch.

6. The solar-powered mattress of claim 5, wherein said three position switch is associated with pictograms depicting inflation, deflation, and stop.

7. The solar-powered mattress of claim 1, wherein said air mattress comprises mattress panels linked together by elastic straps.

8. The solar-powered mattress of claim 7, wherein said elastic straps have different restoring forces, thus enabling automatic folding of said panels according to a planned order.

9. The solar-powered mattress of claim 1, wherein said base of said cylinder further comprises a water container.

10. The solar-powered mattress of claim 1, further comprising:

(v) a separate cooler box provided with a water container, said cooler box adapted to receive an air flow produced by said turbine and to direct said air flow upon water contained in said water container, said water being intended to be evaporated under the effect of the air flow to produce a cooling effect inside the box.

11. The solar-powered mattress of claim 1, wherein said sunshade is attached to said mattress by at least one rod adapted to be fitted into a support sleeve fixed to a clamping device.

12. The solar-powered mattress of claim 1, wherein the sunshade may be attached to said mattress laterally.

13. The solar-powered mattress of claim 12, wherein the sunshade is attached to said mattress by a single rod, with a second rod being capable of being folded onto a rail located on a side of said air mattress.

14. The solar-powered mattress of claim 1, further comprising (vi) bedding in operative relationship with said air mattress and joined thereto by means for attachment.

15. The solar-powered mattress of claim 14, wherein said means for attachment comprise zippers.

16. The solar-powered mattress of claim 1, wherein the mattress is provided with carrying straps and includes at least one storage pocket.

17. The solar-powered mattress of claim 1, wherein a portion of said air mattress intended to be in contact with the ground comprises semi-rigid panels.

18. The solar-powered mattress of claim 17, wherein said semi-rigid panels include a plastic coating which provides insulation from the ground to a user of said mattress.

19. The solar-powered mattress of claim 1, further comprising a valve located in the pipe, said valve adapted to prevent escape of air from said mattress when said switch is at an inflation or stop position, and adapted to permit escape of air from said mattress when said switch is at a deflation position.

20. An inflatable, deflatable and foldable solar-powered mattress, comprising:

(i) an inflatable air mattress having at least one air inlet;

(ii) a device for inflating and deflating the mattress, said device comprising (a) an electric motor;

(b) an array of photovoltaic cells for supplying electric power to operate said motor;

(c) a turbine operatively attached to said motor, said turbine adapted to alternatively force air into and out of said air mattress through said air inlet, thereby inflating and deflating said mattress, respectively, when a polarity of the power supply of said motor is reversed by operating a switch.

21. The solar-powered mattress of claim 20, further comprising (iii) a device adapted to cool a beverage or other foodstuff contained therein, said device comprising (a) a foam cylinder having a base, said cylinder having walls which may be saturated with water;

(b) a diffuser air pipe having many holes and located in said base, (c) an air pipe having one end connected to said porous pipe and whose other end is operatively connected to an air flow produced by said turbine, such that air can be forced through the holes of said porous pipe and cause evaporation of water contained within said cylinder walls, thereby reducing a temperature of said cylinder to produce a cooling effect.

* * * * *